US006164364A

United States Patent [19]

Morris

[11] Patent Number: 6,164,364

[45] Date of Patent: Dec. 26, 2000

[54] TRACK ASSEMBLY FOR SUPPORTING FABRICS

[76] Inventor: Milton A. Morris, 19545 Sherman Way, No. 31, Reseda, Calif. 91335

[21] Appl. No.: 09/369,731

[22] Filed: Jun. 2, 1999

[51] Int. Cl.[7] ..... A47H 23/00

[52] U.S. Cl. ..... 160/327; 52/222; 24/543

[58] Field of Search ..... 160/327, 328, 160/368.1; 52/222, 716.1, 273; 24/530, 543

[56] References Cited

U.S. PATENT DOCUMENTS

| | | |
|---|---|---|
| 2,597,401 | 5/1952 | Swanson . |
| 3,833,046 | 9/1974 | Tombu . |
| 3,848,380 | 11/1974 | Assael . |
| 3,928,897 | 12/1975 | Tombu . |
| 4,053,008 | 10/1977 | Baslow . |
| 4,163,882 | 8/1979 | Baslow . |
| 4,193,235 | 3/1980 | Cucchiara . |
| 4,231,141 | 11/1980 | Derrick et al. . |
| 4,403,642 | 9/1983 | Morris . |
| 4,887,324 | 12/1989 | Cairns . |
| 4,986,332 | 1/1991 | Lanuza . |
| 5,230,377 | 7/1993 | Berman . |
| 5,501,047 | 3/1996 | Delaunay et al. . |

*Primary Examiner*—Blair M. Johnson
*Attorney, Agent, or Firm*—Kelly Bauersfeld Lowry & Kelley, LLP

[57] ABSTRACT

A track assembly for supporting fabrics includes first and second tracks each having one-half of a hinge and one-half of a snapping clamp which, when interfaced, become a hinged clamp. When snapped or clamped together, the tracks tighten and securely clamp fabric to be hung on a wall. The track assembly includes a resilient longitudinal edge and a longitudinal flange spaced inward the edge which configuration allows for the facile creation of tight seams between pieces of fabric along longitudinal edges of respective clamps.

21 Claims, 2 Drawing Sheets

TRACK ASSEMBLY FOR SUPPORTING FABRICS

BACKGROUND OF THE INVENTION

The present invention relates generally to fabric wall coverings and, more particularly, to track assemblies attachable to a wall to create a framework on which a fabric material may be mounted thereby making it possible to cover the surface of a wall without the need to prepare the surface or to adhere the fabric directly to the surface.

It is known to provide a framework formed of plastic channeling fastened by means of staples or other means onto the marginal areas of an interior wall to be covered with a fabric. Such wall, which may be formed of unfinished sheet rock, plaster, cinder block, concrete or wood, requires no preparation other than the installation of the channeling. The fabric material to be applied to the framework is first cut to the exact dimensions required, taking into account that the fabric sheet is to be subjected to tension in the framework. The installation procedure is such as to tension the fabric from top to bottom, thereby imparting to the fabric wall-covering a naturally smooth finish.

Devices and frameworks for supporting fabrics on a wall in the past have utilized border pieces and channel members which, although targeted for the non-professional customers, require the use of tools or fairly complicated systems which require cutting the fabric accurately in order to effectively use the system.

In U.S. Pat. No. 4,403,642 (the contents of which are incorporated herein), a track assembly is disclosed which addresses the problems associated with prior devices. The track assembly generally comprises two tracks each having one half of a hinge and snapping clamp to interlock and clamp shut the two tracks onto one another to secure the fabric. A portion of the snapping clamp of one of the track assemblies comprises a U-shaped stuffing channel, a portion of which includes the edge of the track. When two pieces of fabric are to be joined at a tight seam, the ends of the track assemblies are necessarily abutted to one another. However, the track assembly of the '642 patent does not easily allow the user to form tight seams between two pieces of fabric by adjoining the track assemblies end to end. Due to the configuration of the U-shaped portion of the snapping clamp, when the ends of the assemblies are placed in close proximity at least one of the snapping clamps will not completely clamp shut. This is due to the deformatoin of the U-shaped clamp when increased forces are applied to it by the stretching fabric and the abutting fabric. Therefore, the ends of the assemblies must be spaced just far enough apart to allow the snapping clamps to shut while forming as tight a seam as possible.

Therefore, what is needed is a device which requires no special professional skills nor specialized tools in order to support fabrics on a wall. What is further needed is a device which can be positioned adjacent to similar devices for the creation of tight seams between pieces of fabric. The present invention fulfills these needs and provides other related advantages.

SUMMARY OF THE INVENTION

The present invention contemplates the provision of fabric supporting frame means in the form of a track assembly constituting a further improvement over border pieces, channels and track assemblies presently available, primarily in that the securing of the fabric can be carried out far more rapidly and with superior results, particularly when joining two track assemblies adjacent to one another to form tight seams between separate pieces of fabric.

The fabric supporting track assembly of the present invention comprises, generally, a first track having one longitudinal edge defining a first half of a hinge, and an opposite longitudinal edge of the first track defining a first half of a snapping clamp, fasteners for securing the first track to a wall, and a second track having one longitudinal edge defining a second half of the hinge, an opposite longitudinal edge and a longitudinal flange spaced inwardly from and parallel to the opposite longitudinal edge of the second track, which defines a second half of the snapping clamp. Upon connecting the hinges, the tracks can be snapped shut over one another.

More specifically, the first track has a flat longitudinal central portion for engaging a flat marginal surface of a wall area to be covered with fabric. The central portion includes longitudinally extending spaced parallel protruding lines defining mid-positions. The opposite longitudinal edge of the first track turns away from the wall area in a direction generally normal thereto to define the first half of a snapping clamp.

The fasteners, typically in the form of duplex nails, screws or the like, are receivable at longitudinally spaced points between the protruding lines for securing the flat longitudinal central portion to the flat marginal surface of the wall area.

The second track has a flat longitudinal central portion for positioning in opposed spaced relationship to the first mentioned flat longitudinal central portion. The spacing of the flat longitudinal central portion of the second track in opposed relationship to the first track is sufficient to accommodate the exterior heads of the duplex type nails after the tracks are snapped together. The longitudinal edges of the second track turn toward the wall area. The longitudinal flange extends towards the wall area from the central portion of the second track. An adhesive strip extending longitudinally along the exposed outer surface of the second track may be used to temporarily attach the fabric to the second track.

After securement of the first track to the flat marginal surface of the wall area, the second track can be hinged to the first track by coupling the second half of the hinge with the first half of the hinge, the second track is then swingable about the hinge away from the wall area to facilitate placement of the fabric onto the adhesive strip and over the opposite longitudinal edge and flange of the second track. The second track is then swung into opposing relationship to the first track causing the second half of the snapping clamp to snap over the first half of the snapping clamp to secure the fabric between the second and first snapping clamps and simultaneously stretch and lock the fabric to the first track along the entire one longitudinal edge of the first track.

Track assemblies may be adjoined along the longitudinal edges of the respective second tracks to form a tight seam between two pieces of fabric.

A primary advantage of this invention thus resides in the ability of an installer to very rapidly "frame" the fabric without the need of special tools for "stuffing" the fabric in any type of "resilient slot". Furthermore, track assemblies can be adjoined end to end to form tight seams between two or more pieces of fabric.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
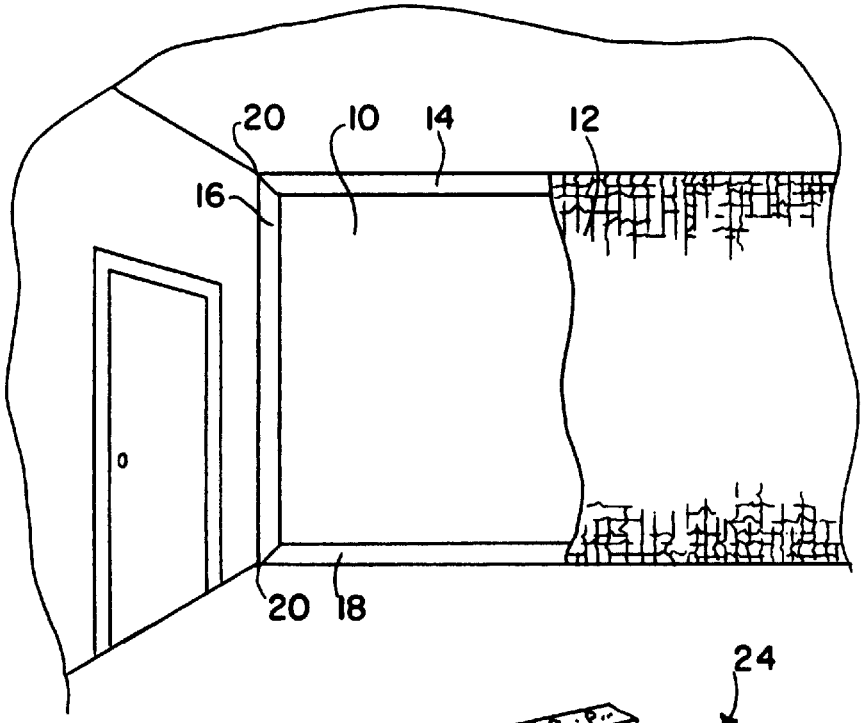
FIG. 1 is a partial perspective view of a typical room wherein one wall is to be covered with fabric utilizing the track assembly of the present invention.

In FIG. 1, there is shown a wall 10 of a room and partly broken away the fabric covering 12 supported by the framework made up of the track assemblies 14–18. The fabric supporting track assembly framework of this invention includes an upper track assembly 14 extending across the top of the wall area 10. Also illustrated is a vertical track assembly 16 running from the top corner of the wall 10 to the bottom corner and finally a lower horizontal track assembly 18 extending along the bottom marginal edge of the wall 10. It will be understood that a fourth vertical track assembly similar to that shown at 14 is provided on the opposite corner of the room.

At the various corners where the horizontal and vertical tracks meet, the tracks themselves may be mitered, typically at 45°, such as indicated at 20 for the track assemblies 12 and 14.

Figure 2:
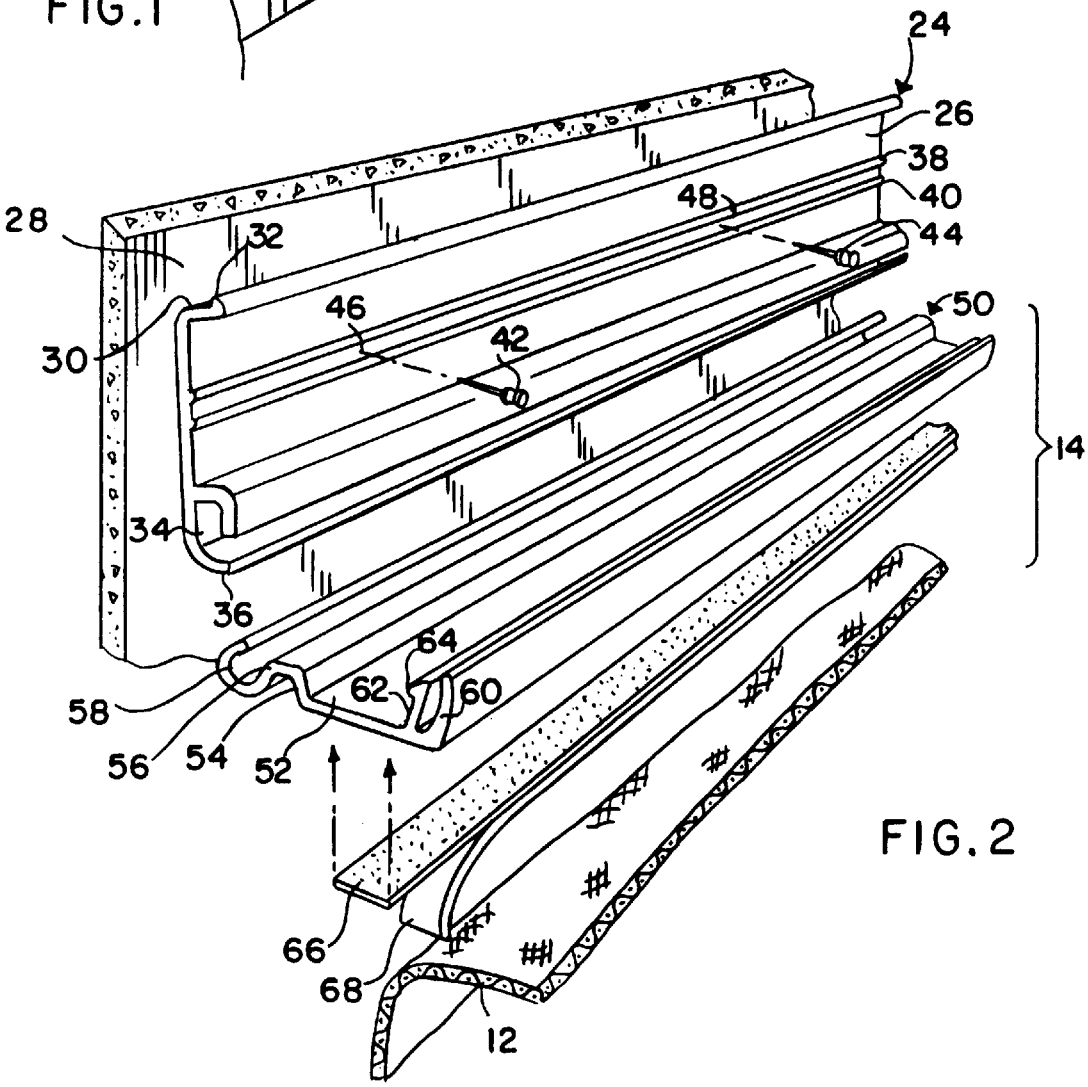
FIG. 2 is an enlarged exploded perspective view of the basic components of the track assembly, further illustrating a piece of a fabric to be secured.

Referring now to the enlarged exploded perspective view of FIG. 2, there are illustrated components making up a top horizontal track assembly indicated at 14 in FIG. 1. These components include a first track 24 preferably composed of extruded polyvinyl chloride plastic material. Track 24 has a flat longitudinal central portion 26 for engaging a flat marginal surface 28 of the wall area 10 to be covered with fabric.

One longitudinal edge of this first track 24 which, in the case of the upper track, constitutes the upper edge, turns away from the wall area 28 in a normal direction thereto as indicated at 30 and thence turns outwardly of the central portion 26 in a direction generally parallel to the wall area 28 as indicated at 32 to define one half of a snapping clamp. The opposite or lower longitudinal edge of the first track 24, in turn is formed into a C-shaped channel 34 opening away from the wall area 28 as indicated at 36 to define one half of a hinge.

Referring again to the central portion 26 of the first track 24, the exposed surface includes longitudinally extending spaced parallel scribe lines 38 and 40 defining a mid-position on the track 24. Fasteners for securing the track 24 to the flat marginal surface 26 of the wall 10 in the specific embodiment shown comprise duplex type nails such as indicated at 42 and 44 receivable at longitudinally spaced points such as 46 and 48 between the scribe lines 38 and 40. By using the duplex type nails 42, 44, they can be easily removed without damaging the track structure, should such removal be necessary. The scribe lines 46 and 48 merely facilitate proper positioning of the fasteners at an appropriate mid-point between the opposite longitudinal edges of the track.

Referring now to the central portion of FIG. 2, there is shown a second extruded track 50 having a flat longitudinal central portion 52 for positioning in opposed spaced relationship to the first mentioned flat longitudinal central portion 52 of the first track when assembled thereon, all as will become clearer as the description proceeds.

One longitudinal edge of the second track 50 turns towards the wall area when the second track is in opposing relationship to the first track as indicated at 54 and thence extends outwardly of the central portion as indicated at 56. Thereafter, this longitudinal edge is formed into a C-shaped channel 58 opening towards the wall 10 to define a second half of the referred to hinge. An opposite longitudinal edge of this second track turns towards the wall area 10 when assembled in opposing relationship to the first track as indicated at 60. Spaced apart from the longitudinal edge 60 towards the central portion 52, a longitudinal flange 62 likewise extends towards the wall area 10 to define the second half of the referred to snapping clamp. The flange 62 includes a nib 64 at one end which interacts with a like-shaped nib 32 on the upper edge 30 of the first track 24.

Referring now to the lower right-hand portion of FIG. 2, there is shown in exploded view an adhesive strip 66 arranged to extend longitudinally along the exposed outer surface of the second track 50 for temporarily holding the fabric 12. A cover strip 68 for the adhesive material is provided and may be manually peeled off to expose the adhesive strip 66 when making an installation.

Figure 3:
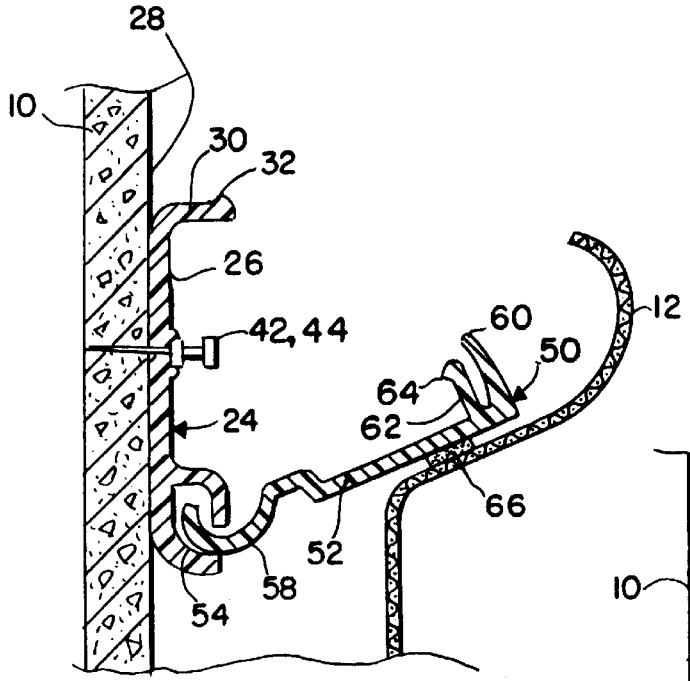
FIG. 3 is a cross-section of the assembled track components of FIG. 2 during an initial stage of installation of the fabric.
Figure 4:
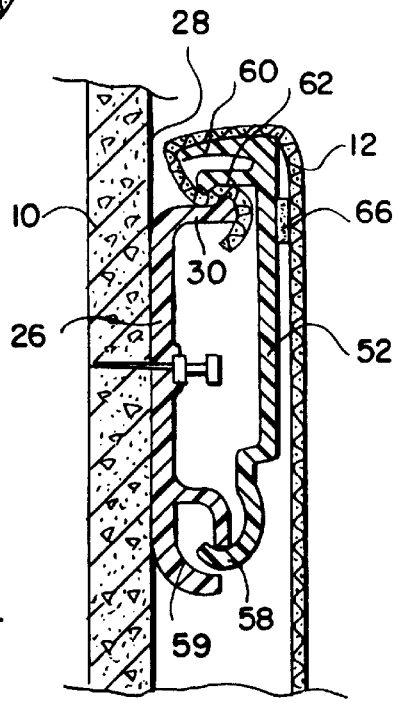
FIG. 4 is a view similar to FIG. 3 but illustrating the track components in their finalized clamped position for stretching and clamping the fabric.

The manner in which the first and second tracks 24 and 50 cooperate to greatly facilitate the stretching and securing of the fabric 12 will now be evident by referring to FIGS. 3 and 4. Referring first to FIG. 3, the first track 24 is shown installed against the flat marginal surface 28 of the wall 10, the duplex nails 42 and 44 or other suitable fasteners being used for this purpose. After securement of this first track 24, the second track 50 is hinged to the first track 24 by interdigitating the second half of the hinge 58 with the first half of the hinge 34 as illustrated in FIG. 3. The second track 50 is then swingable about the hinge away from the wall area 28 to facilitate placement of the fabric material 12 over the opposite longitudinal edge 60 and longitudinal flange 62 of the second track 50. In this respect, it will be understood that the fabric 12 can be conveniently supported as by the adhesive strip 66 as shown in FIG. 3.

After the fabric 12 has been placed over the opposite longitudinal edge 60 and longitudinal flange 62, the entire second track 50 is swung by a single action into opposing relationship with the first track 24. This movement causes the second half of the snapping clamp, namely the flange 62 and nib 64, to snap over the first half 30 and nib 32 of this clamp to effectively simultaneously stretch and lock the fabric 12 to the first track 24 along its entire one longitudinal edge 30. It will be understood that the stretching of the fabric 12 may cause the opposite longitudinal edge 60 of the second track 50 to temporarily deform and bend towards the longitudinal flange 62. The spacing of the flat longitudinal central portions 26 and 52 is sufficient to accommodate the exterior heads of the duplex type nails 42 and 44, or any other suitable fastener, after the tracks 24 and 50 are snapped together.

Figure 5:
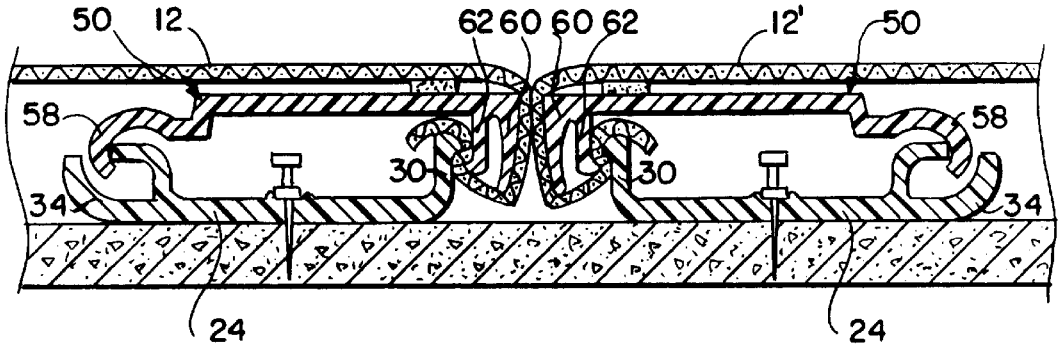
FIG. 5 is a cross-sectional view of two clamped track assemblies adjoining one another to form a tight seam between two pieces of fabric.

Importantly, a seam can be formed between two pieces of fabric 12 and 12' by positioning the longitudinal edges 60 of two track assemblies in close proximity to one another and clamping the fabric 12 or 12' within the respective snapping clamps (FIG. 5).Alternatively, the two track assemblies may be constructed so as to share a common central portion 26 to accomplish the same result in less time. When the fabric 12 or 12' is clamped into the shut assembly, the forces caused by stretching are applied mainly to the base of the longitudinal edge 60 and not the flange 62 of the snapping clamp. As the longitudinal edges 60 can resiliently move towards the flange 62, adequate space is provided for the combined widths of the fabrics 12 and 12' even though the assemblies are placed in close relation to one another. Therefore, very tight seams can easily be formed between two pieces of fabric 12 and 12' without the need to carefully reposition the assemblies relative to one another.

The vertical tracks, such as the track assembly 16 and the lower horizontal tracks, such as the track assembly 18 shown in FIG. 1 are identical to the tracks described in FIG. 2, the hinged portions being always on the inside edge of the frame so that the vertical and lower horizontal portions of the fabric will be properly stretched and clamped. It will be appreciated that the track assemblies can be provided in given lengths so that the first tracks can simply be serially secured in alignment over the top and bottom margins of a wall area to be covered, regardless of the overall length of the room. A last section, of course, could be cut on the job to neatly result in proper fitting to the overall length of the wall. Similarly, appropriate segments can be serially connected in a vertical line along the marginal edge of the wall between the floor and the ceiling. As mentioned, the corner pieces are mitered at an angle as indicated at 20 in FIG. 1.

Since the fabric 12 is placed over the longitudinal edge 60 and flange 62 and into the space between the inner flat portions 26 and 52 of the tracks 24 and 50, tolerances as to the overall dimensions of the fabric itself are not critical. More or less or the fabric 12 can be received in the space between the tracks 24 and 50 and thus professional skill in installation with respect to fabric dimensions is not required.

Finally, because of the one swinging action of the second track into clamping engagement with the first track, the tedious procedure of successive stuffing of the fabric along appropriate channels is avoided as well as the need for any special type of tool to effect such stuffing. It is the upward swinging of the second track 50 into opposed clamping engagement with the first track 24 that will effect the necessary stretching to provide a smooth finish surface and also assure adequate securement of the fabric.

From all of the foregoing, it will now be evident that the present invention has provided a greatly improved fabric supporting track assembly for the covering of walls with fabric material.

Although several embodiments have been described in detail for purposes of illustration, various modifications may be made without departing from the scope and spirit of the invention. Accordingly, the invention is not to be limited, except as by the appended claims.

What is claimed is:

1. A track assembly for supporting fabric on a surface, the assembly comprising:

a first track having one longitudinal edge defining a first half of a hinge, and an opposite longitudinal edge of the first track defining a first half of a snapping clamp;

fasteners for securing the first track to the surface; and a second track having one longitudinal edge defining a second half of the hinge, an opposite longitudinal edge extending generally perpendicular to a primary plane of the second track, and a longitudinal flange spaced inwardly from and parallel to the opposite longitudinal edge of the second track, the flange defining a second half of the snapping clamp;

whereby after securement of the first track to surface the second track can be hinged to the first track by coupling the second half of the hinge with the first half of the hinge, the second track then being swingable about the hinge away from the surface to facilitate placement of a sheet of the sheet of fabric over the opposite longitudinal edge and flange of the second track, and subsequent swinging of the second track into opposing relationship to the first track causing the second half of the snapping clamp to snap over the first half of the snapping clamp to secure the fabric between the second and first snapping clamps and simultaneously stretch and lock the fabric to the first track along the entire opposite longitudinal edge of the first track.

2. The assembly of claim 5, wherein the opposite longitudinal edge of the first track extends from the central portion in a direction generally normal thereto.

3. The assembly of claim 7, wherein the longitudinal edges of the second track extend from the central portion.

4. The assembly of claim 3, wherein the flange of the second track extends from the central portion and generally parallel to the longitudinal edge of the second track.

5. The assembly of claim 1, wherein the first track includes a flat longitudinal central portion between the longitudinal edges thereof for engaging the surface.

6. The assembly of claim 5, wherein an exposed surface of the flat central portion of the first track includes longitudinally extending spaced parallel protruding lines defining mid-positions on the track.

7. The assembly of claim 5, wherein the second track includes a flat longitudinal central portion for positioning in opposed spaced relationship to the central portion of the first track.

8. The assembly of claim 6, wherein the fasteners are receivable at longitudinally spaced points between the protruding lines of the first track for securing the first track to the surface.

9. The assembly of claim 8, wherein the spacing of the flat longitudinal central portion of the second track in opposed relationship to the first track being sufficient to accommodate the exterior heads of the fasteners after the tracks are snapped together.

10. The assembly of claim 1, including an adhesive strip extending longitudinally along the exposed outer surface of the second track for temporarily holding the fabric onto an exterior portion of the second track while placing the fabric over the second half of the snap clamp.

11. The assembly of claim 10, wherein the adhesive strip is removable.

12. The assembly of claim 1, wherein a pair of track assemblies are adjoined along respective longitudinal edges to form a tight seam between two pieces of fabric.

13. A track assembly supporting a sheet of fabric on a surface, the assembly comprising:

a first track having a flat longitudinal central portion for engaging the surface to be covered with fabric, one longitudinal edge of the track defining a first half of a hinge, and an opposite longitudinal edge of the first track extending from the central portion in a direction generally normal thereto to define a first half of a snapping clamp;

fasteners for securing the flat longitudinal central portion to the surface; and a second track having a flat longitudinal central portion for positioning in opposed spaced relationship to the first mentioned flat longitudinal central portion, one longitudinal edge of the second track extending from the flat longitudinal central portion and defining a second half of the hinge, an opposite longitudinal edge of the second track extending from the flat longitudinal central portion, and a longitudinal flange extending from the flat longitudinal central portion of the second track to define a second half of the snapping clamp;

whereby after securement of the first track to the surface, the second track can be hinged to the first track by coupling the second half of the hinge with the first half of the hinge, the second track then being swingable about the hinge away from the surface to facilitate placement of a portion of the sheet of fabric over the opposite longitudinal edge and flange of the second track, and subsequent swinging of the second track into opposing relationship to the first track causing the second half of the snapping clamp to snap over the first half of the snapping clamp to secure the fabric between the second and first snapping clamps and simultaneously stretch and lock the fabric to the first track along the entire opposite longitudinal edge of the first track.

14. The assembly of claim 13, wherein the exposed surface of the flat central portion of the first track includes longitudinally extending spaced parallel protruding lines defining mid-positions on the track.

15. The assembly of claim 14, wherein the fasteners are receivable at longitudinally spaced points between the lines for securing the first track to the surface.

16. The assembly of claim 15, wherein the spacing of the flat longitudinal central portion of the second track in opposed relationship to the first track being sufficient to accommodate the exterior heads of the fasteners after the tracks are snapped together.

17. The assembly of claim 13, including an adhesive strip extending longitudinally along the exposed outer surface of the second track for temporarily holding the fabric onto an exterior portion of the second track while inserting the fabric over the second half of the snap clamp.

18. The assembly of claim 13, wherein a pair of track assemblies are adjoined along respective longitudinal edges to form a tight seam between two pieces of fabric.

19. A track assembly supporting a sheet of fabric on a surface, the assembly comprising:

a first track having a flat longitudinal central portion for engaging a surface area to be covered with fabric, the central portion including longitudinally extending spaced parallel protruding lines defining mid-positions, one longitudinal edge of the track defining a first half of a hinge, and an opposite longitudinal edge of the first track extending from the central portion in a direction generally normal thereto to define a first half of a snapping clamp;

fasteners receivable at longitudinally spaced points between the protruding lines for securing the flat longitudinal central portion to the surface area; and a second track having a flat longitudinal central portion for positioning in opposed spaced relationship to the first mentioned flat longitudinal central portion, one longitudinal edge of the second track extending from the central portion and defining a second half of the hinge, an opposite longitudinal edge of the second track extending from the central portion, a longitudinal flange extending from the central portion of the second track and generally parallel to the opposite longitudinal edge of the second track to define a second half of the snapping clamp, and a removable adhesive strip extending longitudinally along an exposed outer surface of the second track;

whereby after securement of the first track to the surface area, the second track can be hinged to the first track by coupling the second half of the hinge with the first half of the hinge, the second track then being swingable about the hinge away from the surface area to facilitate placement of a portion of the sheet of fabric onto the adhesive strip and over the opposite longitudinal edge and flange of the second track, and subsequent swinging of the second track into opposing relationship to the first track causing the second half of the snapping clamp to snap over the first half of the snapping clamp to secure the fabric between the second and first halves of the snapping clamp and simultaneously stretch and lock the fabric to the first track along the entire one longitudinal edge of the first track.

20. The assembly of claim 19, wherein the spacing of the flat longitudinal central portion of the second track in opposed relationship to the first track is sufficient to accommodate the exterior heads of the fasteners after the tracks are snapped together.

21. The assembly of claim 19, wherein a pair of track assemblies are adjoined along opposite longitudinal edges of the respective second tracks to form a tight seam between two pieces of fabric.

* * * * *